US009854889B2

(12) United States Patent
Amago

(10) Patent No.: US 9,854,889 B2
(45) Date of Patent: Jan. 2, 2018

(54) MULTI-CONFIGURATION BAG WITH COMPARTMENTS HAVING MULTIPLE ACCESS POINTS

(71) Applicant: NIKE, Inc., Beaverton, OR (US)

(72) Inventor: Justin Amago, Portland, OR (US)

(73) Assignee: NIKE, INC., Beaverton, OR (US)

( * ) Notice: Subject to any disclaimer, the term of this patent is extended or adjusted under 35 U.S.C. 154(b) by 121 days.

(21) Appl. No.: 14/723,784

(22) Filed: May 28, 2015

(65) Prior Publication Data

US 2016/0345700 A1 Dec. 1, 2016

(51) Int. Cl.

| | |
|---|---|
| ***A45C 13/10*** | (2006.01) |
| ***A45C 13/02*** | (2006.01) |
| ***A45C 7/00*** | (2006.01) |
| *A45C 3/00* | (2006.01) |

(52) U.S. Cl.

CPC ..... *A45C 13/02* (2013.01); *A45C 7/0095* (2013.01); *A45C 2003/007* (2013.01)

(58) Field of Classification Search

CPC ..... A45C 13/10; A45C 2007/0004; A45C 2003/007; A45C 7/0054; A45C 11/27; A45C 11/26

USPC ..... 190/11, 112, 901, 109; 383/41

See application file for complete search history.

(56) References Cited

U.S. PATENT DOCUMENTS 2,205,205 A 6/1940 King
2,213,821 A * 9/1940 McCurdy ..... A45C 5/00 190/111
2,626,689 A 1/1953 Davis et al.
4,542,824 A 9/1985 Allen
4,693,344 A * 9/1987 Shuler ..... A45C 3/00 190/107
4,753,329 A * 6/1988 Choy ..... A45C 7/0095 190/107
5,413,198 A 5/1995 Ferris
5,628,397 A 5/1997 Ham
5,735,608 A * 4/1998 Branco ..... D06F 95/002 190/903
5,829,502 A 11/1998 Distefano et al.
5,871,280 A * 2/1999 Watters ..... A01K 5/0114 206/216
6,193,034 B1 2/2001 Fournier
6,286,461 B1 * 9/2001 Martz ..... A01K 1/0254 119/497
6,334,519 B1 1/2002 Tong
6,516,751 B2 * 2/2003 Burns ..... A01K 1/0254 119/497
7,604,102 B2 10/2009 Albritton
(Continued)

FOREIGN PATENT DOCUMENTS

GB 2178401 A * 2/1987 ..... A45C 5/00

*Primary Examiner* — Sue A Weaver
(74) *Attorney, Agent, or Firm* — Shook, Hardy & Bacon L.L.P.

(57) ABSTRACT

A bag having two or more compartments for organizing and stowing belongings therein, and the two or more compartments include openings or access points to provide access to storage spaces. The bag may be converted from an unfolded configuration to a folded configuration, such that the individual compartments fit together to form the unitary configuration of the bag. Each compartment includes at least one opening that provides access to the compartment's interior whether the bag is in a folded or a unitary configuration.

20 Claims, 12 Drawing Sheets

(56) References Cited

U.S. PATENT DOCUMENTS

| | | | | |
|---|---|---|---|---|
| 7,798,323 | B1 | 9/2010 | McCann et al. | |
| 8,074,853 | B1 | 12/2011 | Hirshberg | |
| 8,152,037 | B2 | 4/2012 | Sabbag | |
| 8,181,775 | B2 | 5/2012 | Bunn | |
| 8,449,186 | B2 | 5/2013 | Bray | |
| 8,651,353 | B2 | 2/2014 | Koutouras et al. | |
| 9,314,077 | B2 * | 4/2016 | Scicluna | A45C 11/00 |
| 2002/0067865 | A1 | 6/2002 | Stutzman | |
| 2003/0188943 | A1 * | 10/2003 | Freedman | D06F 95/002 190/112 |
| 2004/0045780 | A1 * | 3/2004 | Bernbaum | A45C 3/00 190/109 |
| 2004/0134813 | A1 | 7/2004 | Domotor | |
| 2004/0188204 | A1 * | 9/2004 | Wilkins-Langie | A45C 7/0095 190/111 |
| 2005/0034949 | A1 * | 2/2005 | Davies | A45C 7/0036 190/107 |
| 2009/0255770 | A1 * | 10/2009 | Slater | A45C 9/00 190/1 |
| 2010/0142862 | A1 | 6/2010 | Sam | |
| 2011/0110611 | A1 | 5/2011 | Apple | |
| 2012/0241337 | A1 | 9/2012 | Allegrini | |
| 2013/0075288 | A1 | 3/2013 | Bielski | |

* cited by examiner

MULTI-CONFIGURATION BAG WITH COMPARTMENTS HAVING MULTIPLE ACCESS POINTS

TECHNICAL FIELD

The present disclosure relates to a bag having compartments with multiple access points that provide access to the compartments when the bag is in various configurations.

BACKGROUND

Some styles of bags include a main compartment that is used to store several relatively smaller items or a few relatively larger items. These bags might also include other compartments or pockets either inside, or external to, the main compartment. A "duffel bag" is an example of this style of bag.

Items stored in a main compartment can sometimes be disorganized. For example, the items might shift during transport or might have been initially positioned within the main compartment in a disorganized manner. Disorganized storage can create challenges in various contexts, such as when the bag is used to provide items quickly and as needed. That is, specific items might be relatively difficult to locate within the main storage compartment in a time-sensitive scenario (e.g., "on-demand" or "on-site"), if the items are disorganized. Time-sensitive scenarios might include a variety of different uses and contexts. For example, an athlete might want to access or store her race-day equipment, apparel, and nutrients.

BRIEF SUMMARY

This Summary is provided to introduce a selection of concepts in a simplified form that are further described below in the Detailed Description. This Summary is not intended to identify key features or essential elements of the claimed subject matter, nor is it intended to be used as an aid in determining the scope of the claimed subject matter. The present invention is defined by the claims.

At a high level, exemplary aspects herein include a bag that includes a plurality of compartments, which are convertible between a lay-flat arrangement and a folded arrangement. Each of the plurality of compartments includes more than one opening or access point that allow the compartment's interior to be accessed regardless of whether the plurality of compartments is in the lay-flat arrangement or in the folded arrangement.

BRIEF DESCRIPTION OF THE DRAWINGS

The present invention is described in detail herein with reference to the attached drawing figures, which are incorporated herein by reference, wherein.

DETAILED DESCRIPTION

The subject matter of aspects of the present invention is described with specificity herein to meet statutory requirements. But the description itself is not intended to necessarily limit the scope of claims. Rather, the claimed subject matter might be embodied or carried out in other ways to include different elements or combinations of elements similar to the ones described in this document, in conjunction with other present or future technologies.

Generally, aspects hereof provide a bag with multiple compartments that are convertible between various configurations and that each includes multiple openings for accessing the compartment regardless of the configuration. For instance, the compartments of the bag may be configured at least two ways, which include an unfolded state (e.g., lay-flat configuration) and a folded state. The plurality of openings provides access to the compartment storage spaces when the bag is in the unfolded and the folded states and various states in between (i.e., between completely unfolded and completely folded).

The term "bag" may be used herein for simplicity, in reference to various examples of articles for carrying personal belongings. However, concepts described herein may be applied to a variety of bags or articles for carrying personal belongings or other contents. Examples of bags include a backpack, a duffel bag, a gym bag, a hold-all bag, a weekender bag, a shoulder bag, a cross-body bag, a messenger bag, a tote bag, a rucksack, or the like. Various permutations and iterations of the aspects of exemplary bags are contemplated herein and the invention is not to be construed as limited to the specific or particular embodiments disclosed herein.

First Exemplary Bifold-Style Bag

Figure 1:
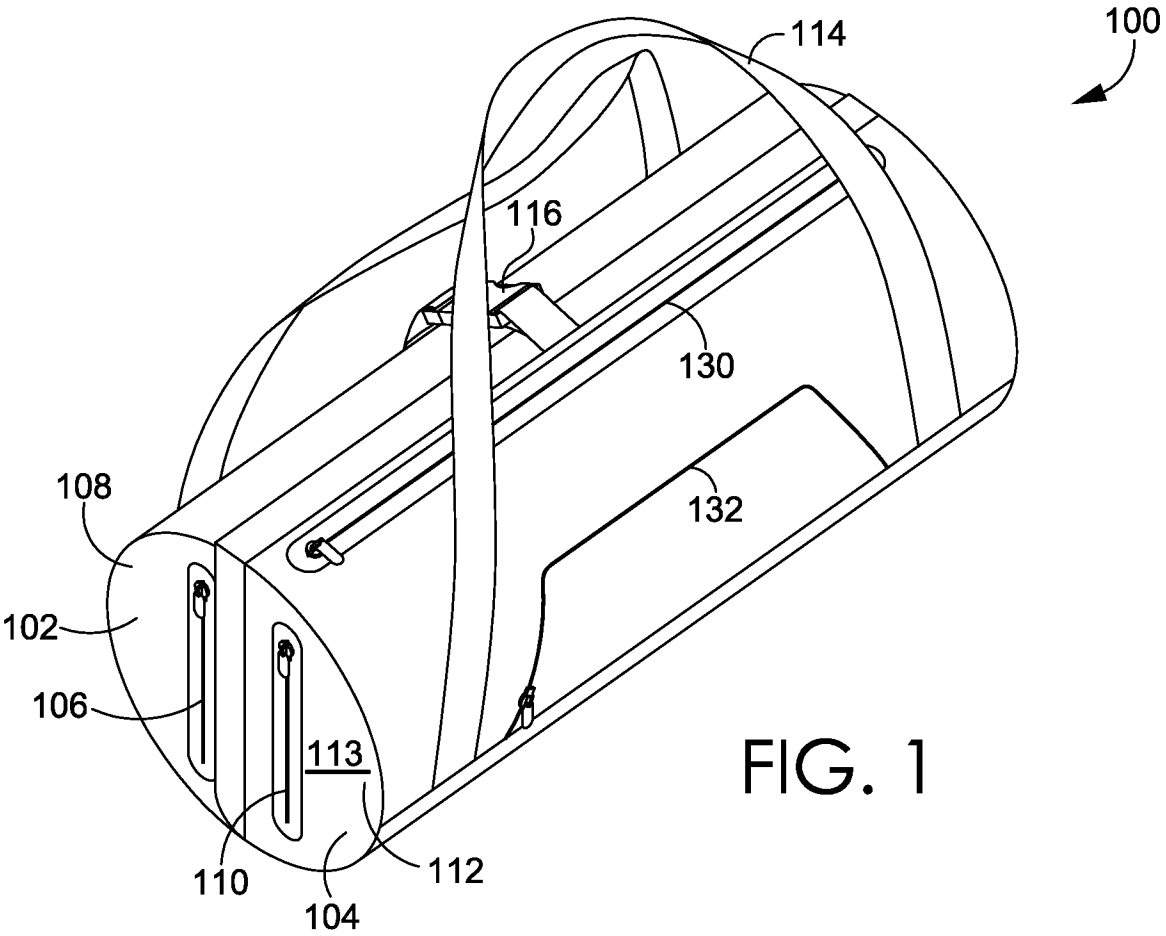
FIG. 1 depicts a bag in a folded configuration in accordance with an exemplary aspect hereof.
Figure 2:
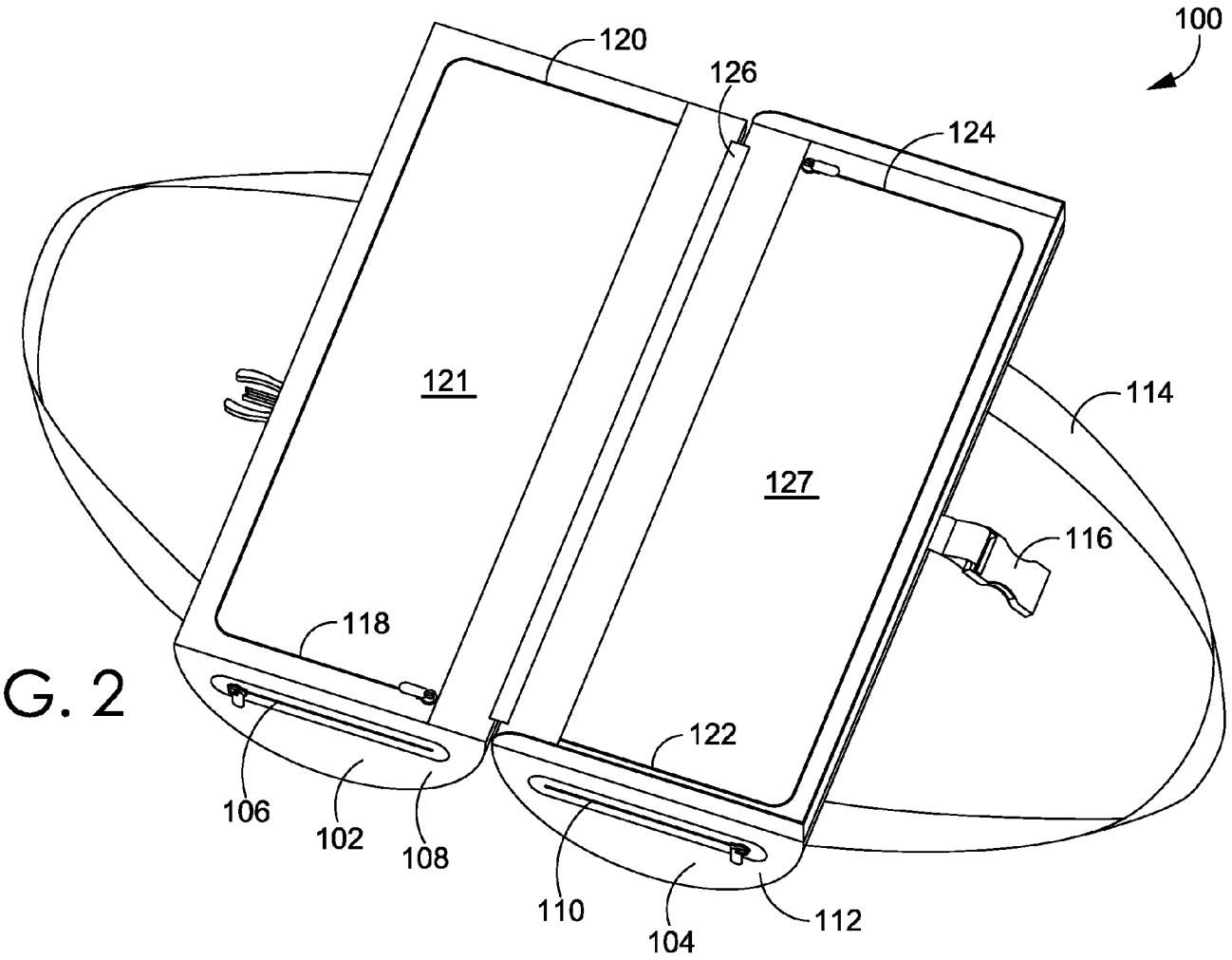
FIG. 2 depicts the bag of FIG. 1 in an unfolded configuration in accordance with an exemplary aspect hereof.
Figure 3:
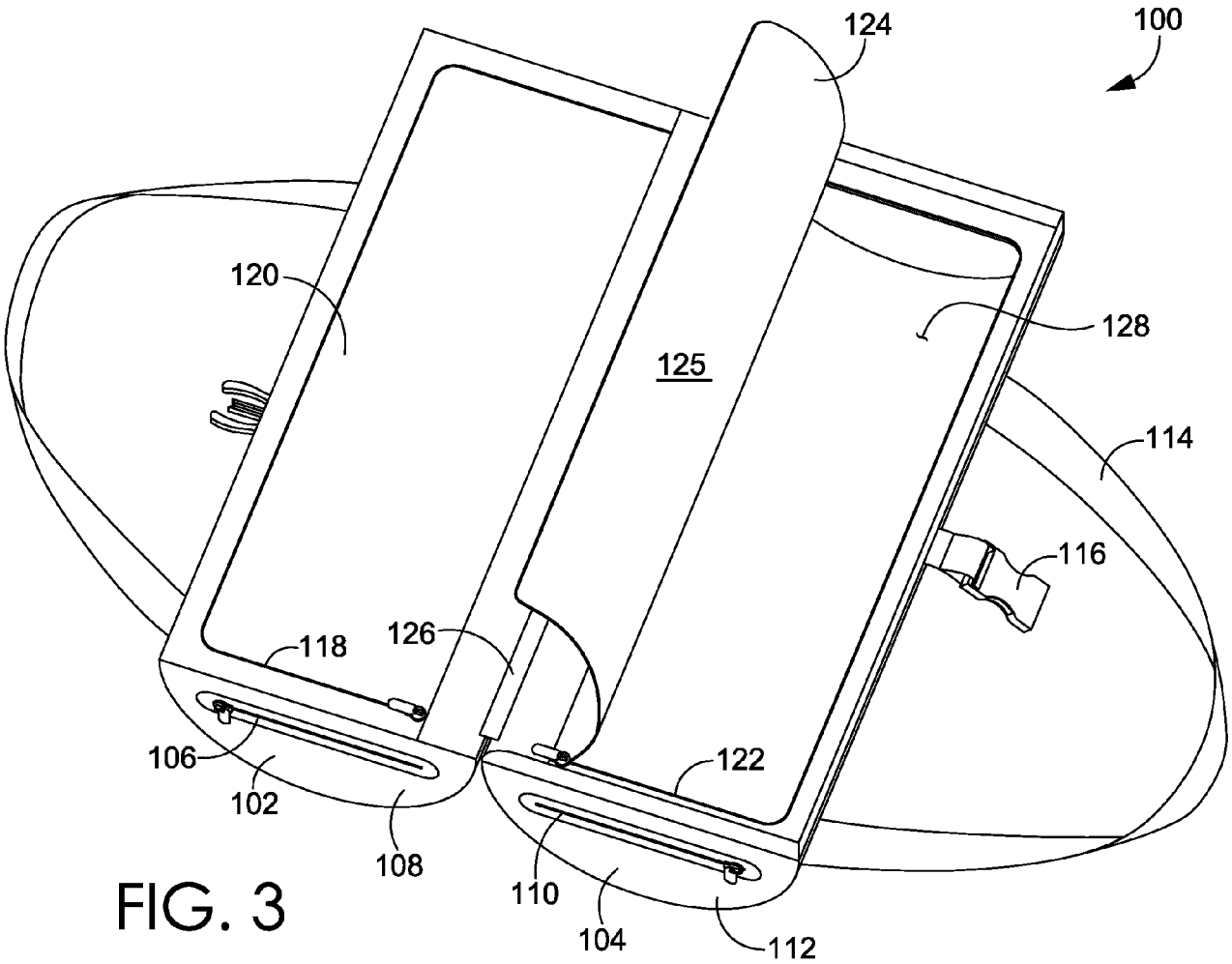
FIG. 3 depicts the bag of FIGS. 1 and 2 in an unfolded configuration with an access point open in accordance with an exemplary aspect hereof.

FIGS. 1-3 depict different configurations of a first exemplary bifold-style bag 100. For instance, FIG. 1 depicts the bag 100 in a folded configuration, whereas FIGS. 2 and 3 illustrated the bag 100 in an unfolded, or lay-flat, configuration. In addition, FIG. 3 depicts an opening, which is useable to manage access to a storage compartment. Although reference might be made to a particular figure when describing this first exemplary bifold-style bag, the other figures might also depict that aspect of the bag 100 and might be useful to help illustrate the various features.

Referring now to FIG. 1, a bag 100 is depicted in a folded configuration and the bag 100 includes a first compartment 102 and a second compartment 104. In aspects, the first compartment 102 is divided from the second compartment 104. Generally, the first compartment 102 is separated from the second compartment 104 such that belongings placed within the first compartment 102 do not migrate or shift to the second compartment 104 and such that belongings placed within the first compartment 102 remain separate from belongings stored within the second compartment 104. The first and second compartments 102 and 104 may be located opposite one another, generally, such that the first compartment 102 corresponds to a first portion of the bag 100 while the second compartment 104 corresponds to a second portion of the bag 100.

In a further aspect, each of the first compartment 102 and the second compartment 104 correspond, approximately, to separate and generally equal (e.g., with respect to exterior and/or interior size, shape, and/or volume) halves of the bag 100. In one example, a first compartment 102 comprises a top half of the bag 100 and the second compartment 104 comprises a bottom half of the bag 100. In another example, the first compartment 102 comprises a right side or a right half of the bag 100 and the second compartment 104 comprises a left side or a left half of the bag 100. In other aspects, the first compartment 102 comprises or corresponds to more than half of the bag 100 or the second compartment 104 comprises or corresponds to more than half of the bag 100.

Independent of the respective portions of the bag 100 comprised of or corresponding to the first compartment 102 and/or the second compartment 104, each of the first and second compartments 102 and 104 includes more than one opening or access point that provide access to the interior of said compartment to which the opening corresponds. The first compartment 102 includes a first opening 106 placed in a first wall 108 and a second opening (obstructed from view in FIG. 1) placed in a second wall (obstructed from view in FIG. 1). The second compartment 104 includes a third opening 110 placed in a third wall 112 and a fourth opening (obstructed from view in FIG. 1) placed in a fourth wall (obstructed from view in FIG. 1).

As depicted in FIG. 1, the first wall 108 and the third wall 112 are exterior facing whereas the second wall (120 in FIG. 2) and the fourth wall (124 in FIG. 2) are interior facing, with respect to the exterior of the bag 100 in the folded configuration. The second wall 120 may be configured to prevent contents and belongings stored in the first compartment 102 from spilling out of the first compartment 102 and possibly into the second compartment 104, and the fourth wall 124 may be configured similarly to prevent items stored in the second compartment 104 from spilling out of the second compartment 104 and possibly into the first compartment 102. As such, the second wall 120 and the fourth wall 124 may act as dividers or separators between the first and second compartments 102 and 104.

As depicted in the folded configuration of FIG. 1, the exemplary bag 100 is a duffel-type bag having two similarly shaped compartments (e.g., the first and second compartments 102 and 104). In this particular aspect, each of the three-dimensional structures of the similarly shaped first and second compartments 102 and 104, when placed together in the folded configuration, form a single or unitary three-dimensional shape or structure of the bag 100. As such, the folded configuration refers to a folded configuration, and it might be referred to as such in various parts of this description.

The folded configuration might be useful for carrying, wearing, or otherwise transporting the bag 100 with stored personal belongings. In FIG. 1, each of the first and second compartments 102 and 104 have a three-dimensional shape of a bisected cylinder, such that when the first and second compartment 102 and 104 are placed together, they form a single, unitary, cylindrically shaped duffel bag 100. As such, each of the first and second compartments 102 and 104 are of a similar size and shape such that each compartment generally forms approximately one half of the bag 100.

In other aspects, various compartments are not similar in size and/or shape and may correspond to more than half of the bag or less than half of the bag. Generally, the size and/or shape of the compartments of a bag 100 complement one another so as to fit together and form a folded or unitary three-dimensional structure of the bag 100, when in a folded configuration. In various aspects, the bag 100 is approximately cylindrical in shape, box shaped, cuboid shaped, trapezoid shaped, or other prism shape, and accordingly, the compartments comprising the bag 100 correspond to portions of the cylindrical, box, cuboid, trapezoid, or other prism shape of the bag 100. Other three-dimensional shapes or structures of the bag and its compartments are contemplated to be within the scope of this disclosure, and some further aspects are described herein with regard to the figures.

In the folded configuration of FIG. 1, the first wall 108 of the first compartment 102 abuts, meets, and/or is placed alongside the third wall 112 of the second compartment 104. That is, the first wall 108 and the third wall 112 may be coplanar, or near coplanar, to one another so as to form an external surface of the bag 100, the plane corresponding to an external surface of the bag 100. In addition, a side or portion of the first wall 108 might overlap a side or portion of the third wall 112. In other words, as the first wall 108 abuts the third wall 112, the first wall and the third wall create a near continuous surface or side of the bag 100 as a whole. In FIG. 1, the external surface of the bag 100 includes the first opening 106 and the third opening 110 positioned and/or placed therein. In this manner, the first opening 106 and the third opening 110 provide access to an interior of the respective first and second compartments 102 and 104, and any belongings or cargo therein, when the bag 100 is in the folded configuration.

In the folded configuration, the second wall (120 in FIG. 2) faces, and possibly contacts, at least a portion of the fourth wall (124 in FIG. 2) such that the second opening (118) and the fourth opening (122) are positioned between or enclosed between the first compartment 102 and the second compartment 104. As such, the second opening 118 and the fourth opening are not outwardly visible and are not easily accessible in the folded configuration. In aspects, a face of the second wall contacts a face of the fourth wall such that the second opening and the fourth opening are enclosed between the second wall and the fourth wall and are not exteriorly accessible in the folded configuration. Accordingly, the first wall 108 and the third wall 112 face outward (e.g., exterior of the bag 100) whereas the second wall and the fourth wall face inward (e.g., interior of the bag 100) with respect to the bag 100 in the folded configuration.

In other aspects, the first compartment 102 and the second compartment 104 might include additional openings that provide access to the compartments when the bag is in the folded configuration. For example, the second compartment 104 includes one or more openings 130 and 132 in addition to the third opening 110. The additional openings 130 and 132 are accessible from the exterior of the bag 100 in the folded configuration. As shown, the second compartment 104 includes at least two openings (e.g., third opening 110 and first additional opening 130) that provide access to the interior of the second compartment 104 in the folded configuration. For example, the first additional opening 130 provides access to the interior of the second compartment 104 in addition to the third opening 110. In some embodiments, a second additional opening 132 provides access to a pouch or pocket that is separate from the second compartment 104. In another example, the additional opening 132 provides access to a pouch or pocket that is placed within or shared with the interior of the second compartment 104.

The bag 100 further includes at least one arm strap 114 for carrying the bag, and in FIG. 1, the bag 100 includes two arm straps 114 or two handles. The at least one arm strap 114 may be placed and/or configured in multiple ways depending on the size and shape of the bag 100, as well as the materials comprising the at least one arm strap 114, for example. The two arm straps 114 depicted in FIG. 1 and their placement is merely one example of a possible arm strap placement and configuration. The arm strap placement and configuration may be selected based on the unfolded configuration of the bag 100 in addition to the folded configuration.

In addition, the bag 100 includes at least one fastener 116 for securing the bag 100 in a folded configuration by releasably connecting the first compartment 102 to the second compartment 104. The exemplary fastener 116 depicted in FIG. 1 includes a male component and a female component. The male component and the female component of the fastener 116 couple to one another to secure the bag 100 in the folded configuration shown. It will be understood by those in the art that any number and/or types of fasteners may be utilized to secure the bag 100 in the folded configuration, and the male component and the female component depicted in FIG. 1 should not be construed as limiting.

FIG. 2 depicts the bag 100 of FIG. 1 in an unfolded configuration. The exemplary bag 100 includes the first compartment 102 having the first opening 106 positioned and/or placed in the first wall 108 and the second opening 118 positioned and/placed in the second wall 120. The bag 100 further includes the second compartment 104 having the third opening 110 placed in the third wall 112 and the fourth opening 122 placed in the fourth wall 124. The second wall 120 and the fourth wall 124, which were interiorly located in the folded configuration are more easily accessible in the unfolded configuration. In the unfolded configuration, the bag 100 is essentially laid flat to more easily access the second opening 118 and the fourth opening 122 to manage the storage and retrieval of items.

The first and second compartments 102 and 104 are hingedly connected by at least one compartment joining member 126, as shown. The compartment joining member 126 acts as an axis or a hinge about which the first and second compartments 102 and 104 may pivot, hinge, or otherwise be articulated around in the unfolded configuration. The compartment joining member 126 enables the first and second compartments 102 and 104 to be changed or converted from the folded configuration of FIG. 1 to the unfolded configuration of FIG. 2, and vice versa, in aspects. For example, from the folded configuration, the bag 100 fastener 116 may be released (e.g., unbuckled, unhinged, or untied) and the first and second compartments 102 and 104 may be pulled away from one another to spread the compartments 102 and 104 out. The action of converting the bag 100 from the folded configuration to the unfolded configuration may be analogized to the action of opening a book, such that the compartment joining member 126 may be analogized to the binding of the book and the compartments 102 and 104 may be analogized to the cover of the book.

Generally, the unfolded configuration provides increased access to openings of compartments so that contents and belongings may be packed in an organizational fashion by a user. In the unfolded configuration, the first and second compartments 102 and 104 may be spread out, laid out, splayed, expanded, or otherwise arranged such that the first compartment 102 is separate from the second compartment 104, albeit connected to the second compartment 104 via the compartment joining member 126. In particular, in the unfolded configuration, the second opening 118 and the fourth opening 122 are accessible and provide additional, improved, and/or increased access to the interiors of the first and second compartments 102 and 104, respectively, in addition to the first opening 106 and the third opening 110. For example, the second opening 118 may be manipulated in a fully open position, which creates a large opening into which belongings may be placed and stored (see, e.g., FIG. 3). The fourth opening 122 may be similarly configured. In this way, the unfolded configuration provides for packing, storing, organizing, and/or otherwise placing personal belongings into the separate compartments of the bag 100 using the second and fourth openings 118 and 122 in addition to the first and third openings 106 and 110.

FIG. 3 depicts the exemplary bag 100 of FIG. 1 in an unfolded configuration, in accordance with certain aspects. As shown, the first, second, third, and fourth openings 106, 118, 110, 122 are all accessible in the unfolded configuration. Each of the first, second, third, and fourth openings 106, 118, 110, 122 may be manipulated into an open position and a closed position using any type of suitable fastener (e.g., zipper). As such, the first, second, third, and fourth openings 106, 118, 110, 122 are resealable such that they may be repetitively opened to receive contents or belongings and repetitively closed to retain contents or belongings. The fourth opening 122 of the second compartment 104 is shown as manipulated into an open position whereas the second opening 118 of the first compartment 102 is shown in a closed position. In general, the fourth opening may be manipulated into an open position such that the fourth wall 124 or a portion thereof may be folded over to form a flap and an interior 128 of the second compartment 104 to be accessed. This enables a user to access the interior space 128 of the second compartment 104. The second wall 120 may be similarly opened and folded over to provide access to an interior space (not shown) of the first compartment 102 in the unfolded configuration.

The bag 100 depicted in FIGS. 1-3 might be used in various manners. For example, a user might wish to prepare for a particular activity that requires certain gear, apparel, hydration, energy sources, and the like, such as a marathon race. Although a marathon race is described herein, the bag 100 is useful for preparing for various other activities, such as other running events, track-and-field events, hiking, traveling, and the like. The user can place the bag 100 into the unfolded (i.e., lay-flat) configuration to pack his or her race-day kit. The user manipulates the second opening 118 of the second wall 120 of the first compartment 102 into an open position. By moving at least a portion of the second wall 120 over to form a flap, the user packs pre-marathon needs into the first compartment 102. Then the user manipulates the second opening 118 of the second wall 120 of the first compartment 102 into a closed position to seal the contents within the first compartment 102. Next, the user manipulates the fourth opening 122 of the fourth wall 124 of the second compartment 104 into an open position. By moving at least a portion of the fourth wall 124 over to form a flap, the user packs his or her post-marathon needs into the second compartment 104. When finished, the user manipulates the fourth opening 122 of the fourth wall 124 of the second compartment 104 into a closed position to seal the contents within the second compartment 104. As sealed, the pre-marathon contents of the first compartment 102 will not mix with the post-marathon contents of the second compartment 104. The user may then convert the bag 100 from the unfolded configuration into the folded configuration and engage the fastener 116 to secure the bag 100 in the folded configuration. As secured, the second wall 120 abuts the fourth wall 124 on the interior of the bag 100. The user may then realize that he or she forgot to pack an item into the first compartment 102 that corresponds to the pre-marathon needs. As the bag 100 is now in the folded configuration, the user manipulates the first opening 106 of the first compartment 102 to quickly access the first compartment 102 contents and pack the forgotten item therein. As such, the user need not convert the bag 100 back to the unfolded configuration to insert the forgotten item. Now, the user is ready to carry the bag 100 and transport his or her marathon kit along. On race-day, the user has all of his or her marathon needs ready as organized within the bag 100, which helps the user prepare, mentally and practically, for the marathon race. After the race, the user can quickly access his or her post-marathon contents (e.g., dry socks) of the second compartment 104 through the third opening 110 and/or a first additional opening 130 without needing to change the configuration of the bag 100.

Second Exemplary Bifold-Style Bag

Figure 4:
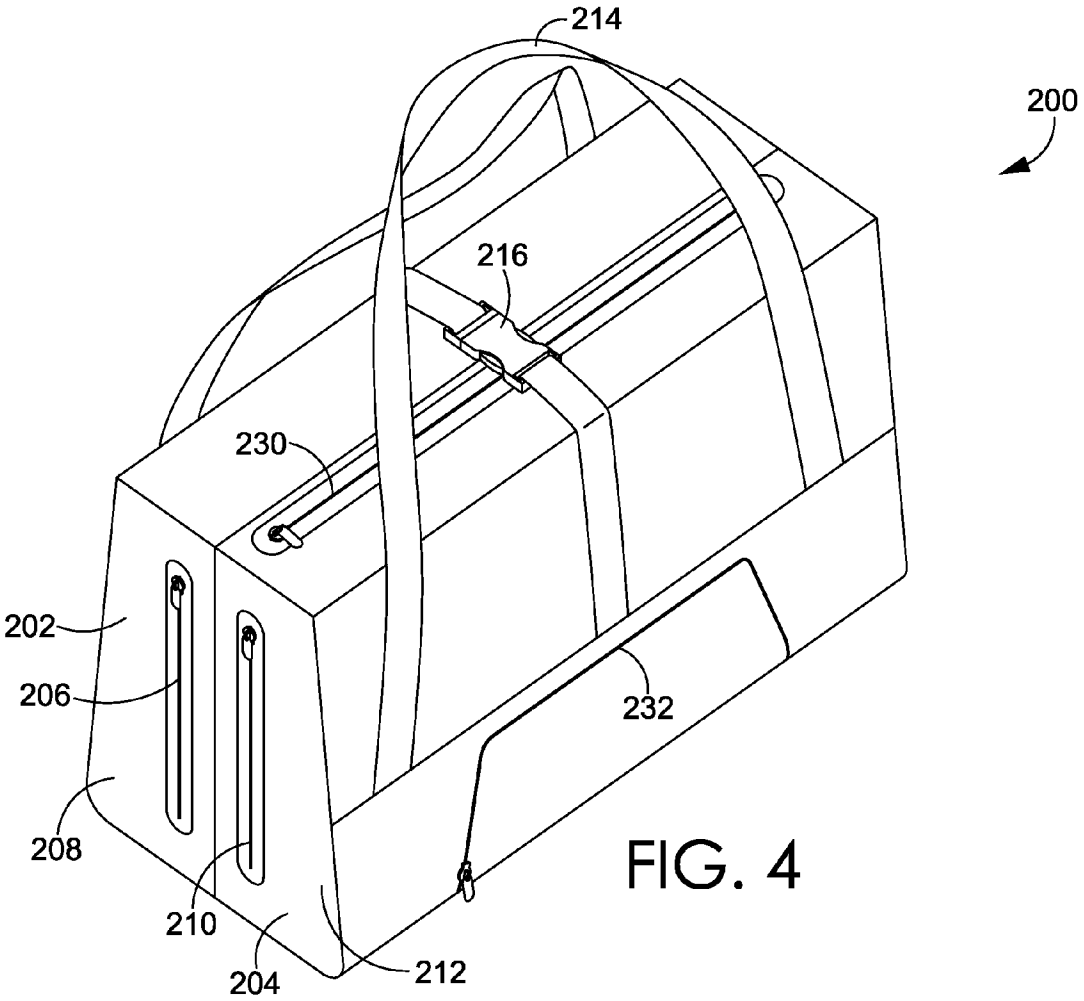
FIG. 4 depicts a second bag in a folded configuration in accordance with an exemplary aspect hereof.
Figure 5:
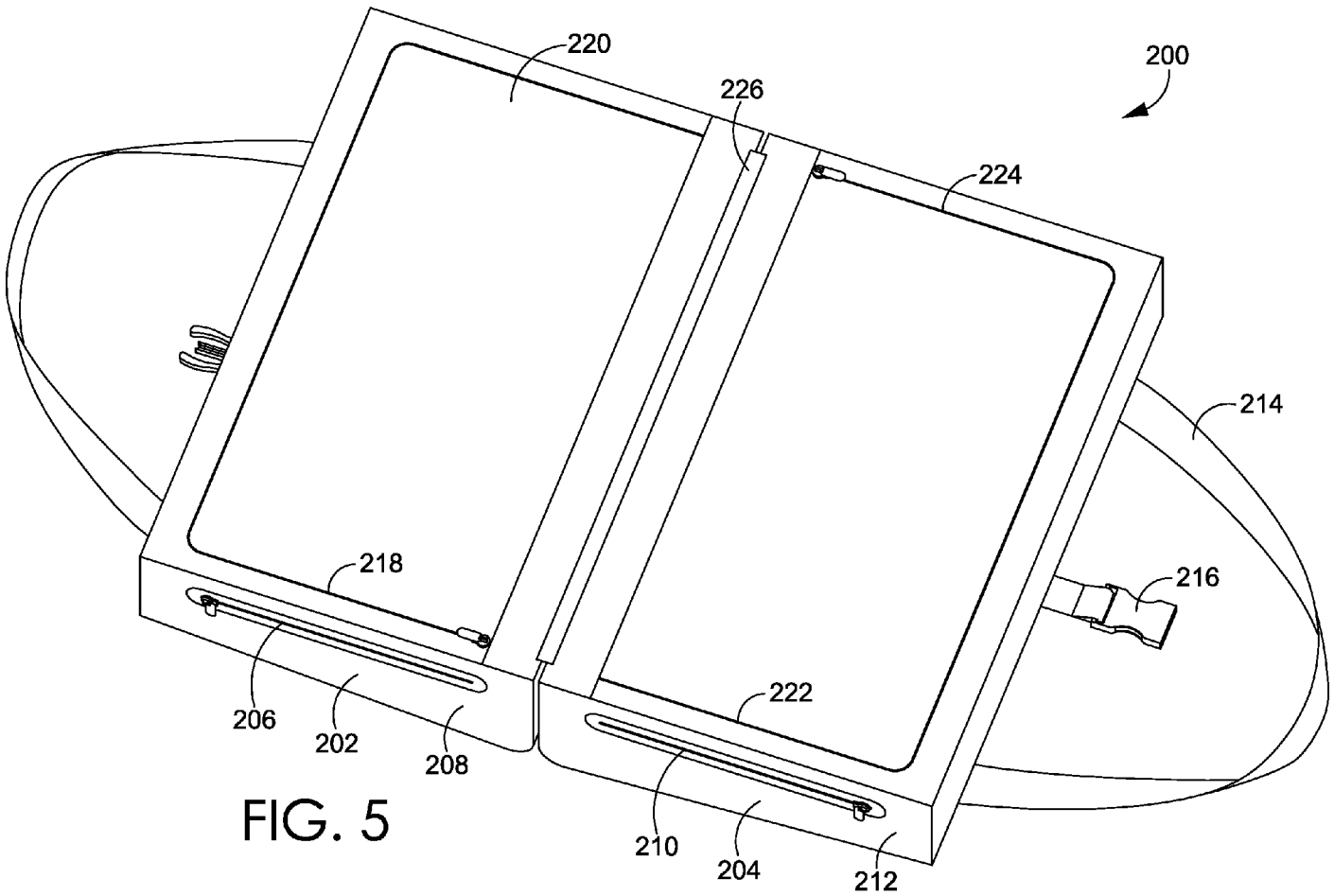
FIG. 5 depicts the bag of FIG. 4 in an unfolded configuration in accordance with an exemplary aspect hereof.
Figure 6:
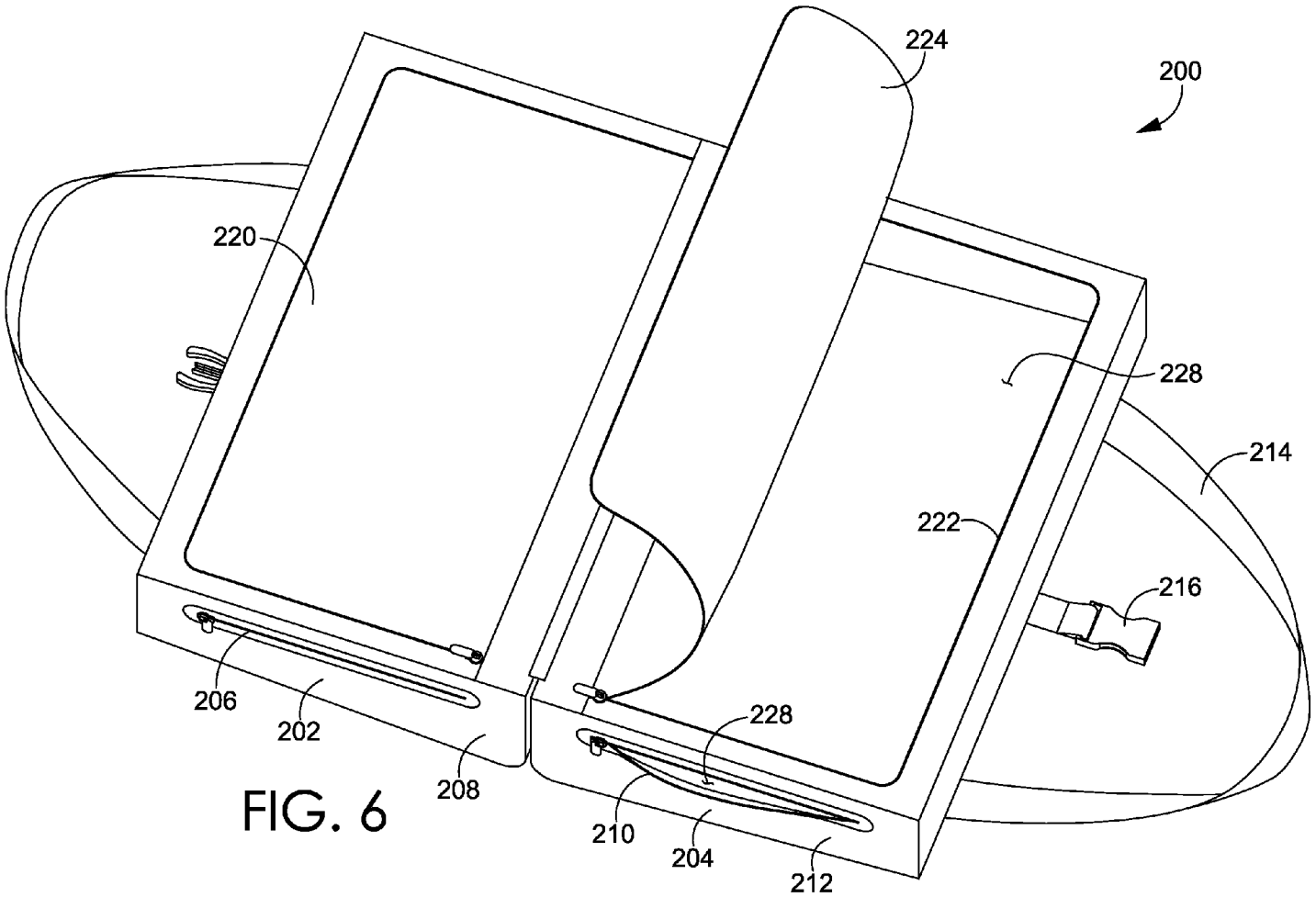
FIG. 6 depicts the bag of FIGS. 4 and 5 in an unfolded configuration with an access point open in accordance with an exemplary aspect hereof.

Referring now to FIGS. 4-6, a second exemplary bifold-style bag 200 is depicted in different configurations. For instance, FIG. 4 depicts the bag 200 in a folded configuration, whereas FIGS. 5 and 6 illustrate the bag 200 in an unfolded, or lay-flat, configuration. In addition, FIG. 6 depicts an opening, which is useable to manage access to a storage compartment. Although reference might be made to a particular figure when describing this second exemplary bifold-style bag, the other figures might also depict that aspect of the bag 200 and might be useful to help illustrate the various features.

Continuing to FIG. 4, an exemplary bag 200 is depicted in a folded configuration, in accordance with certain aspects. The exemplary bag 200 of FIG. 4 comprises a first compartment 202 and a second compartment 204. The first compartment 202 includes a first opening 206 placed in a first wall 208 and a second opening (218 in FIG. 5) placed in a second wall (220 in FIG. 5). The second compartment 204 includes a third opening 210 placed in a third wall 212 and a fourth opening (222 in FIG. 5) placed in a fourth wall (224 in FIG. 5). The bag 200 further includes at least one arm strap 214 for carrying the bag and a fastener 216 comprising a male component and a female component. The male component and the female component of the fastener 216 couple to one another to secure the bag 200 in the folded configuration shown.

As depicted in the folded configuration of FIG. 4, the exemplary bag 200 is a duffel-type bag having two similarly shaped compartments (e.g., the first and second compartments 202 and 204). In this particular aspect, each of the three-dimensional structures of the similarly shaped first and second compartments 202 and 204, when placed together in the folded configuration, form a single or unitary three-dimensional shape or structure of the bag 200. As such, the folded configuration refers to a unitary configuration. In this particular aspect, the first and second compartments 202 and 204 each have a generally rectangular-shaped cross section such that when placed together in the folded configuration, the single unitary structure of the bag 200 has a generally rectangular-shaped cross section. Additionally, in further aspects, each of the first and second compartments 202 and 204 generally correspond to one half of the bag 200. Alternatively, in some aspects, one compartment may correspond to more than one half, whereas another compartment may correspond to less than one half.

In the folded configuration of FIG. 4, the first wall 208 of the first compartment 202 abuts, meets, and/or is placed alongside the third wall 212 of the second compartment 204. That is, the first wall 208 and the third wall 212 may be coplanar, or near coplanar, to one another so as to form an external surface of the bag 200, the plane corresponding to an external surface of the bag 200. In addition, a side or portion of the first wall 208 might overlap a side or portion of the third wall 212. In other words, as the first wall 208 abuts the third wall 212, the first wall and the third wall create a near continuous surface or side of the bag 200 as a whole. In FIG. 4, the external surface of the bag 200 includes the first opening 206 and the third opening 210 positioned and/or placed therein. In this manner, the first opening 206 and the third opening 210 provide access to an interior of the respective first and second compartments 202 and 204, and any belongings or cargo therein, when the bag 200 is in the folded configuration.

In the folded configuration, the second wall (220 in FIG. 5) faces, and possibly contacts, at least a portion of the fourth wall (224 in FIG. 5) such that the second opening (218) and the fourth opening (222) are positioned between or enclosed between the first compartment 202 and the second compartment 204. As such, the second opening 218 and the fourth opening 222 are not outwardly visible and are not easily accessible in the folded configuration. In aspects, a face of the second wall contacts a face of the fourth wall such that the second opening and the fourth opening are enclosed between the second wall and the fourth wall and are not exteriorly accessible in the folded configuration. Accordingly, the first wall 208 and the third wall 212 face outward (e.g., exterior of the bag 200) whereas the second wall and the fourth wall face inward (e.g., interior of the bag 200) with respect to the bag 200 in the folded configuration.

FIG. 5 depicts the bag 200 of FIG. 4 in an unfolded (i.e., lay-flat) configuration, in accordance with certain aspects. The exemplary bag 200 includes the first compartment 202 having the first opening 206 positioned or placed in the first wall 208 and the second opening 218 placed in the second wall 220. The bag 200 further includes the second compartment 204 having the third opening 210 placed in the third wall 212 and the fourth opening 222 placed in the fourth wall 224. As depicted in the unfolded configuration, the first and second compartments 202 and 204 are hingedly connected by at least one compartment joining member 226. The compartment joining member 226 acts as an axis or a hinge about which the first and second compartments 202 and 204 may pivot, hinge, or otherwise be articulated around. The compartment joining member 226 enables the first and second compartments 202 and 204 to be changed or converted from the folded configuration of FIG. 4 to the unfolded configuration of FIG. 5, and vice versa, in aspects.

In the unfolded configuration, the first and second compartments 202 and 204 may be spread out, laid out, splayed, expanded, or otherwise arranged such that the first compartment 202 is laid out apart from the second compartment 204 but still connected via the compartment joining member 226. The second opening 218 and the fourth opening 222 are accessible and provide access to the interiors of the first and second compartments 202 and 204, respectively, in addition to the first opening 206 and the third opening 210.

FIG. 6 depicts the exemplary bag 200 of FIG. 4 in the unfolded configuration, in accordance with certain aspects. In FIG. 6, the fourth opening 222 of the second compartment 204 is depicted in an open position while the second opening 218 of the first compartment 202 is depicted in a closed position. The first, second, third, and fourth openings 206, 218, 210, 222 may be manipulated into an open position or a closed position using a fastener, such as a zipper, for example. The exemplary bag 200 of FIG. 6 includes zippers. The fourth wall 224 or a portion thereof may be manipulated into an open position such that the fourth wall 224 or a portion thereof is folded over to form a flap, thereby allowing access to an interior space 228 of the second compartment 204. The second wall 220 may be similarly opened and folded over to provide access to an interior space (not shown) of the first compartment 202.

First Exemplary Trifold-Style Bag

Figure 7:
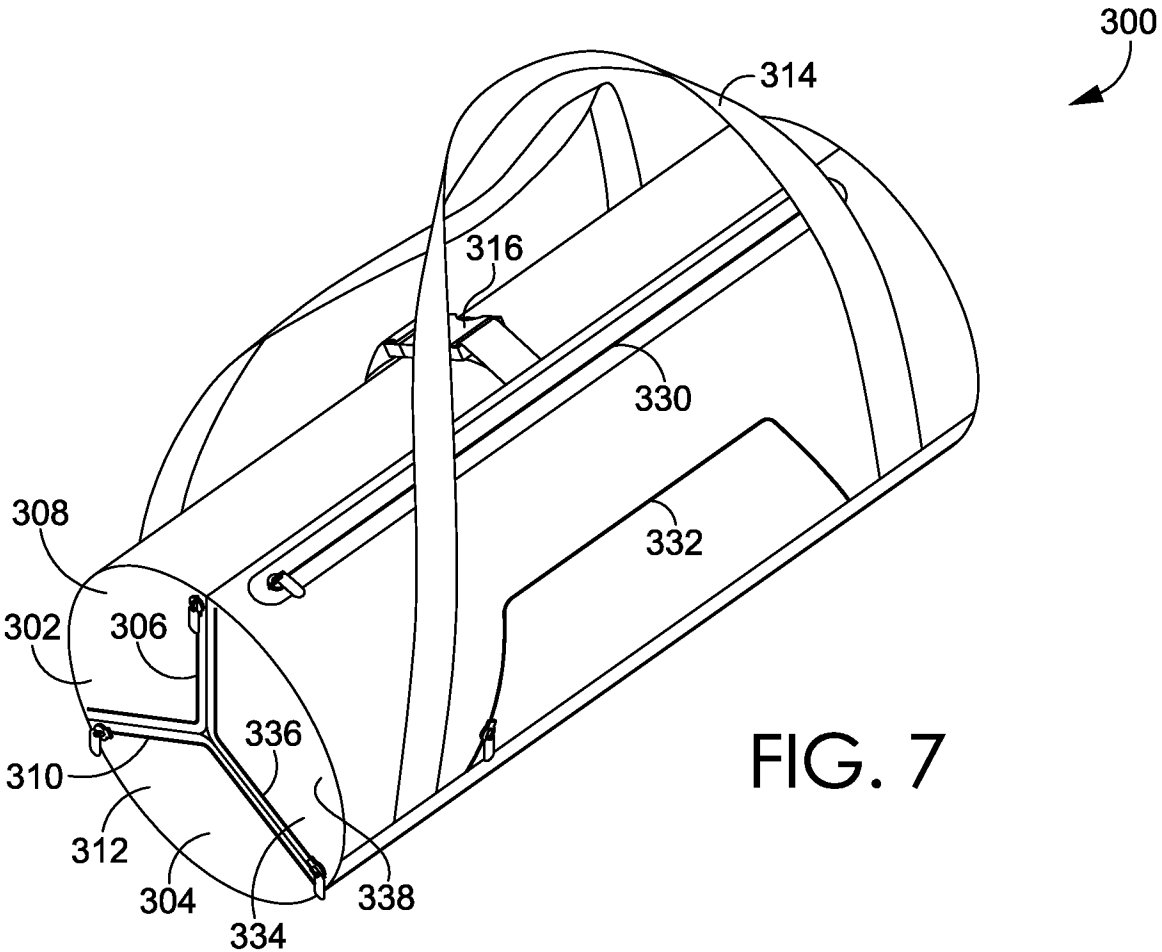
FIG. 7 depicts a third bag in a folded configuration in accordance with an exemplary aspect hereof.
Figure 8:
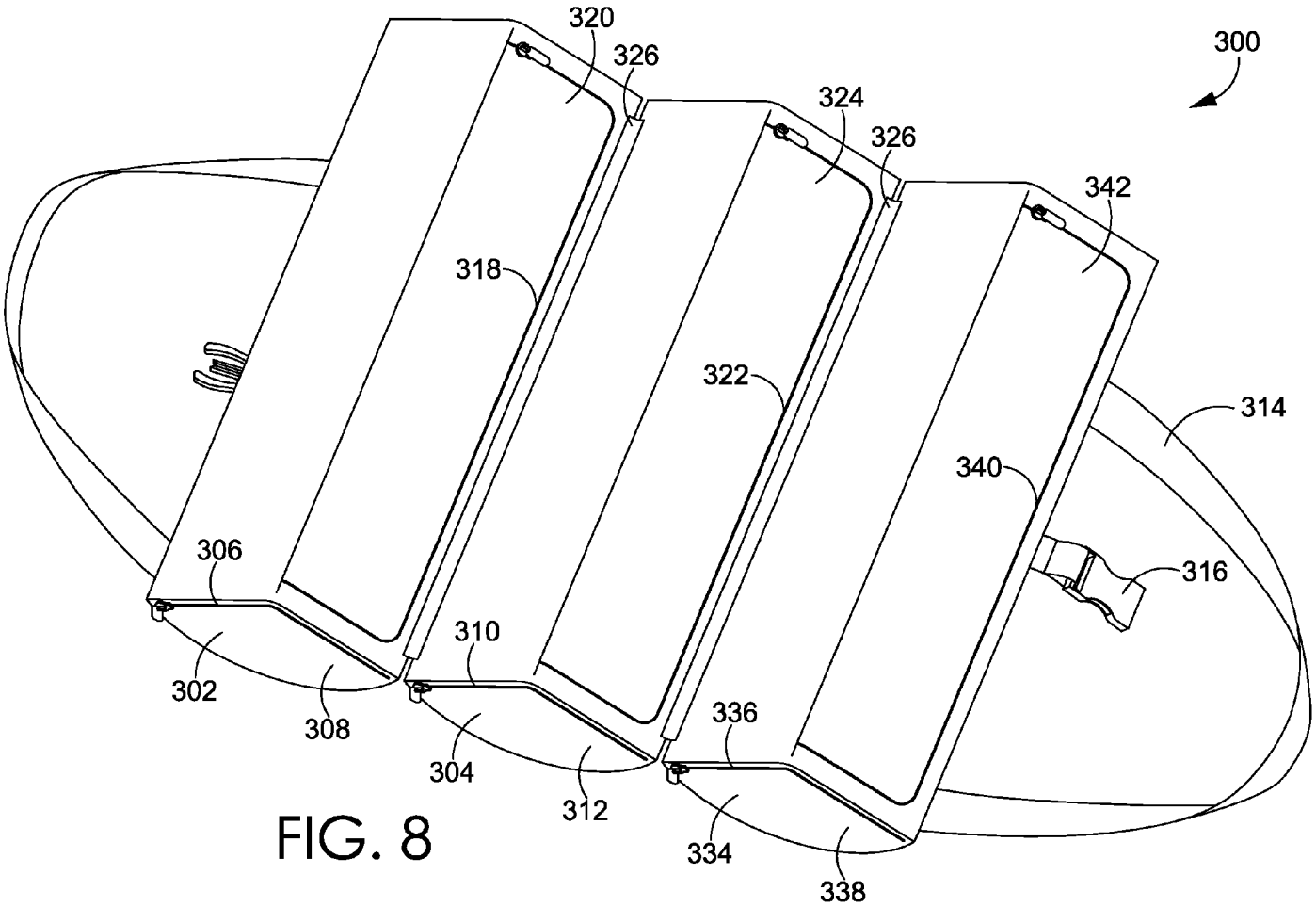
FIG. 8 depicts the bag of FIG. 7 in an unfolded configuration in accordance with an exemplary aspect hereof.
Figure 9:
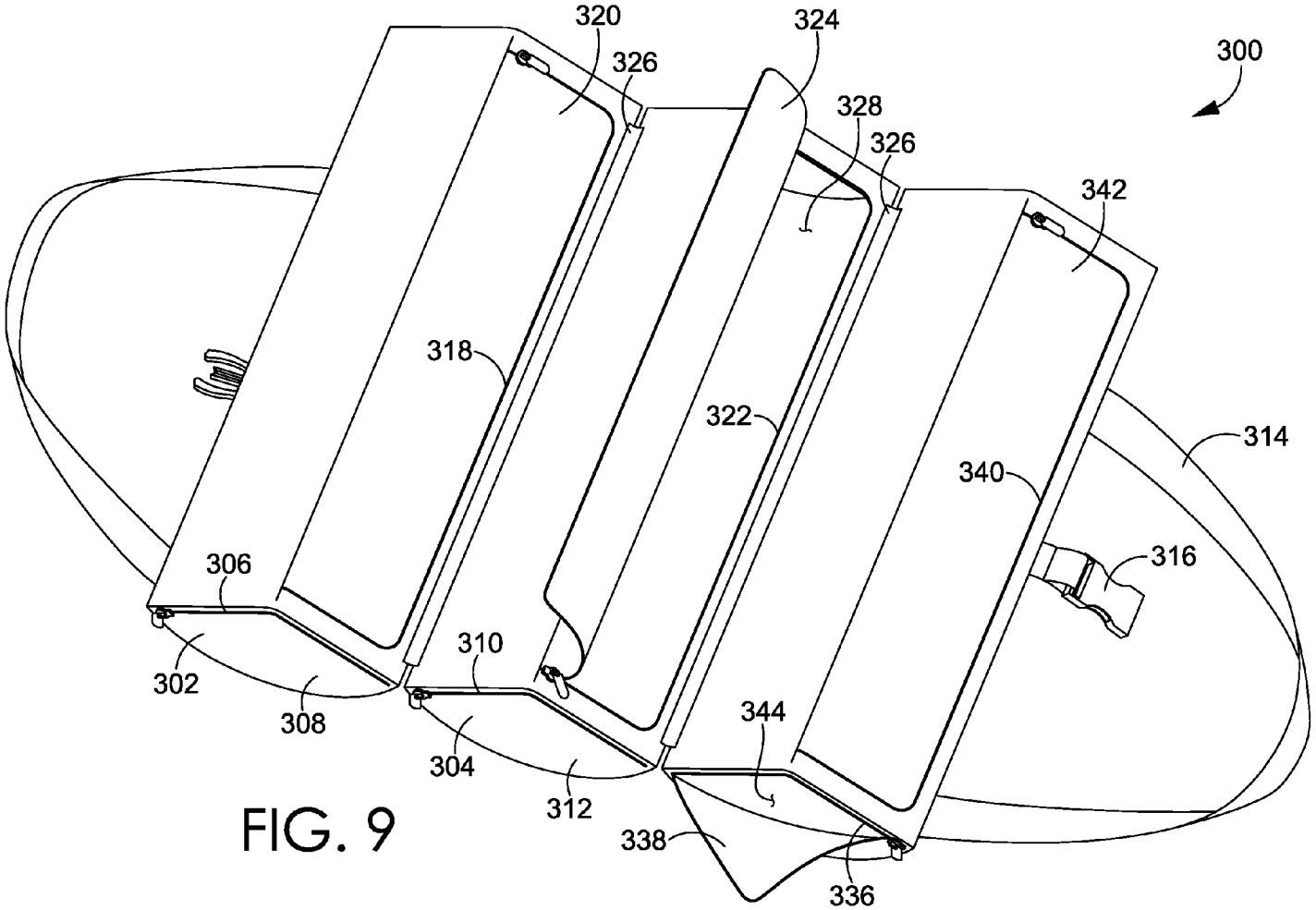
FIG. 9 depicts the bag of FIGS. 7 and 8 in an unfolded configuration with some access points open in accordance with an exemplary aspect hereof.

Referring now to FIGS. 7-9, an exemplary trifold-style bag 300 is depicted in different configurations. For instance, FIG. 7 depicts the bag 300 in a folded configuration, whereas FIGS. 8 and 9 illustrate the bag 300 in an unfolded, or lay-flat, configuration. In addition, FIG. 9 depicts an opening, which is useable to manage access to a storage compartment. Although reference might be made to a particular figure when describing this exemplary trifold-style bag, the other figures might also depict that aspect of the bag 300 and might be useful to help illustrate the various features.

FIG. 7 illustrates the bag 300 in a folded configuration, in accordance with certain aspects. The exemplary bag 300 of FIG. 7 includes a first compartment 302, a second compartment 304, and a third compartment 334. The first compartment 302 includes a first opening 306 placed in a first wall 308 and a second opening (hidden from view in FIG. 7 and identified as 318 in FIG. 8) placed in a second wall (320 in FIG. 8). The second compartment 304 includes a third opening 310 placed in a third wall 312 and a fourth opening (322 in FIG. 8) placed in a fourth wall (324 in FIG. 8). The third compartment 334 includes a fifth opening 336 placed in a fifth wall 338 and a sixth opening (340 in FIG. 8) placed in a sixth wall (342 in FIG. 8).

The bag 300 further includes at least one arm strap 314 for carrying the bag and a fastener 316 comprising a male component and a female component. The male component and the female component of the fastener 316 couple to one another to secure the bag 300 in the folded configuration shown. Although a male/female-style connector is depicted, other styles of connectors might alternatively be used, such as a flexible strip employing a hook-and-loop fastening system, snaps, etc.

In aspects, one or more compartments of the bag 300 include at least one additional opening (e.g., 330 and 332) for managing access to the bag storage compartments. For example, a first additional opening 330 provides access to the interior of the third compartment 334. In addition, a second additional opening 332 might provide access to another pouch or pocket, which could be separate from the third compartment 334 or encased within the third compartment 334. Alternatively, the second additional opening 332 might provide access to the interior storage space of the third compartment 334. It will be understood by those in the art that one or more additional openings 330 and 332 may provide access to any of the compartments on which it is positioned or placed.

In the aspect depicted in FIG. 7, the bag 300 includes three compartments that are the same or similar in size and shape. In one aspect, each of the three compartments have a pie-slice shaped cross section such that the three compartments, when placed into the folded configuration, form a single unitary three-dimensional structure having a generally circular-shaped cross section. However, in further aspects, the bag 300 includes more than three compartments. For example, the bag includes a fourth compartment having a seventh opening placed in a seventh wall and an eighth opening placed in an eighth wall, in one further aspect. Any number of compartments may be employed, and further, compartments may be further divided therein. Additionally, each compartment may include more than two walls, in aspects. The size and shape of each three-dimensional structure of each compartment contributes to the single or unitary three-dimensional structure of the bag 300 formed when the compartments are placed together in the folded configuration. In the folded configuration, the first opening 306, the third opening 310, and the fifth opening 336 provide access to the interiors of each of the first compartment 302, the second compartment 304, and the third compartment 334, respectively.

FIG. 8 depicts the exemplary bag 300 of FIG. 7 in an unfolded configuration. As shown, the bag 300 may be opened up, laid flat, or unfurled such that the second opening 318, the fourth opening 322, and the sixth opening 340 of the first, second, and third compartments 302, 304 and 334, respectively, are easily accessible. In aspects, the second wall 320 or a portion thereof may be manipulated into an open position such that the second wall 320 or a portion thereof is folded over to form a flap, thereby allowing access to an interior space (not shown) of the first compartment 302. The fourth wall 324 and the sixth wall 342 may be similarly opened and folded over to provide access to an interior space (not shown) of the second compartment 304 and the third compartment 334.

The compartment joining member 326 includes a first member or a first portion that connects the first compartment 302 to the second compartment 304 and a separate second member or a second portion that connects the second compartment 304 to the third compartment 334. Alternatively, the compartment joining member 326 is a single continuous member that connects the first compartment 302 to the second compartment 304 and the second compartment 304 to the third compartment 334.

FIG. 9 depicts the exemplary bag 300 of FIG. 7 in an unfolded configuration. As depicted, the fourth opening 322 of the fourth wall 324 or a portion thereof may be manipulated into an open position such that the fourth wall 324 or a portion thereof is folded over to form a flap, thereby allowing access to an interior space 328 of the second compartment 304 through the fourth opening 322. The second wall 320 may be similarly opened and folded over to provide access to an interior space (not shown) of the first compartment 302. The sixth wall 342 may be similarly manipulated to provide access to an interior space 344 of the third compartment 334. As such, in the unfolded configuration, not only are the first, third, and fifth openings 306, 310, 336 accessible, but the second, fourth, and sixth openings 318, 322, 340 are accessible as well. Further, the compartment joining member 326 couples the first compartment 302 to the second compartment 304 and the second compartment 304 to the third compartment 334.

In one aspect, a user might wish to prepare for an event, activity, or competition (e.g., race, dance competition, or a recital). The user could place the bag 300 into the unfolded configuration on a surface (e.g., bed or dresser) to begin packing a recital kit. The user manipulates the second opening 318 of the second wall 320 of the first compartment 302 into an open position. By moving at least a portion of the second wall 320 over to form a flap, the user packs their ballet needs (e.g., toe shoes, resin, tights, and hairpins) into the first compartment 302. Then the user manipulates the second opening 318 of the second wall 320 of the first compartment 302 into a closed position to seal the contents within the first compartment 302. Next, the user manipulates the fourth opening 322 of the fourth wall 324 of the second compartment 304 into an open position. By moving at least a portion of the fourth wall 324 over to form a flap, the user packs his or her tap needs (e.g., tap shoes and costume) into the second compartment 304. When finished, the user manipulates the fourth opening 322 of the fourth wall 324 of the second compartment 304 into a closed position to seal the contents within the second compartment 304. Next, the user manipulates the sixth opening 340 of the sixth wall 342 of the third compartment 334 into an open position. By moving at least a portion of the sixth wall 342 over to form a flap, the user packs his or her modern dance needs (e.g., lyrical shoes and copy of music) into the third compartment 334. Then the user manipulates the sixth opening 340 of the sixth wall 342 of the third compartment 334 into a closed position to seal the contents within the third compartment 334. As sealed, the ballet-related contents of the first compartment 302 will not mix with the tap-related contents of the second compartment 304, or the modern-related contents of the third compartment 334. The user may then convert the bag 300 from the unfolded configuration into the folded configuration and engage the fastener 316 to secure the bag 300 in the folded configuration. As secured, the second, fourth, and sixth walls 320, 324, 342 will abut other interior walls of the bag 300. The user may then realize that he or she forgot to pack an item into the first compartment 302 that corresponds to the ballet-related contents. As the bag is now in the folded configuration, the user manipulates the first opening 306, which is exteriorly accessible, of the first compartment 302 to quickly access the first compartment 302 contents and pack the forgotten item therein. As such, the user need not convert the bag 300 back to the unfolded configuration to insert the forgotten item. Now, the user is ready to carry the bag 300 and transport his or her recital kit. On the day of recital, the user has all of his or her dance needs ready as organized within the bag 300, which helps the user prepare, mentally and practically, for the recital. During the recital, the user can quickly access the modern-related contents of the third compartment 334 through the fifth opening 336 and/or a first additional opening 330 without disturbing the contents of the other compartments, and without needing to change the configuration of the bag 300. This saves time for the user, which is essential during quick costume changes and shoe swaps during a recital performance.

Second Exemplary Trifold-Style Bag

Figure 10:
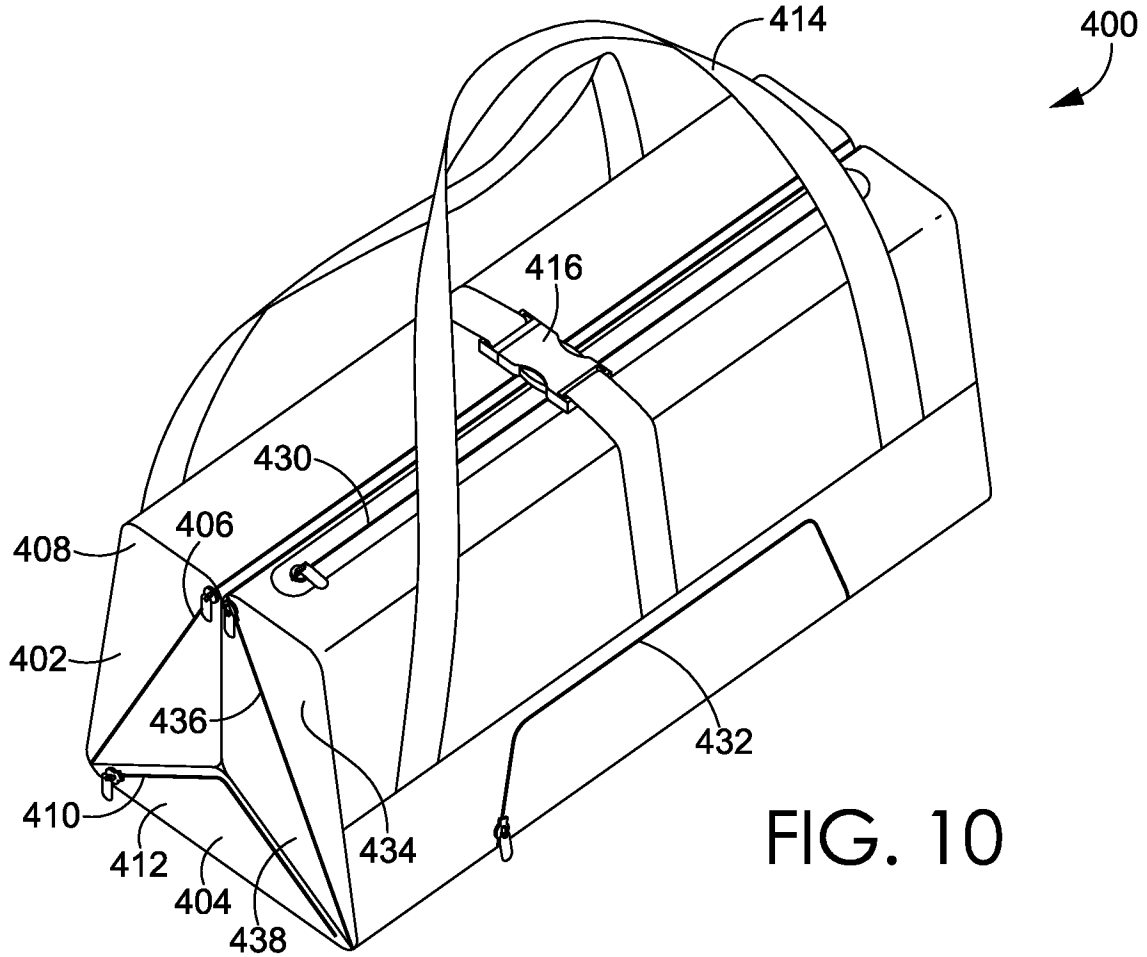
FIG. 10 depicts a fourth bag in a folded configuration in accordance with an exemplary aspect hereof.
Figure 11:
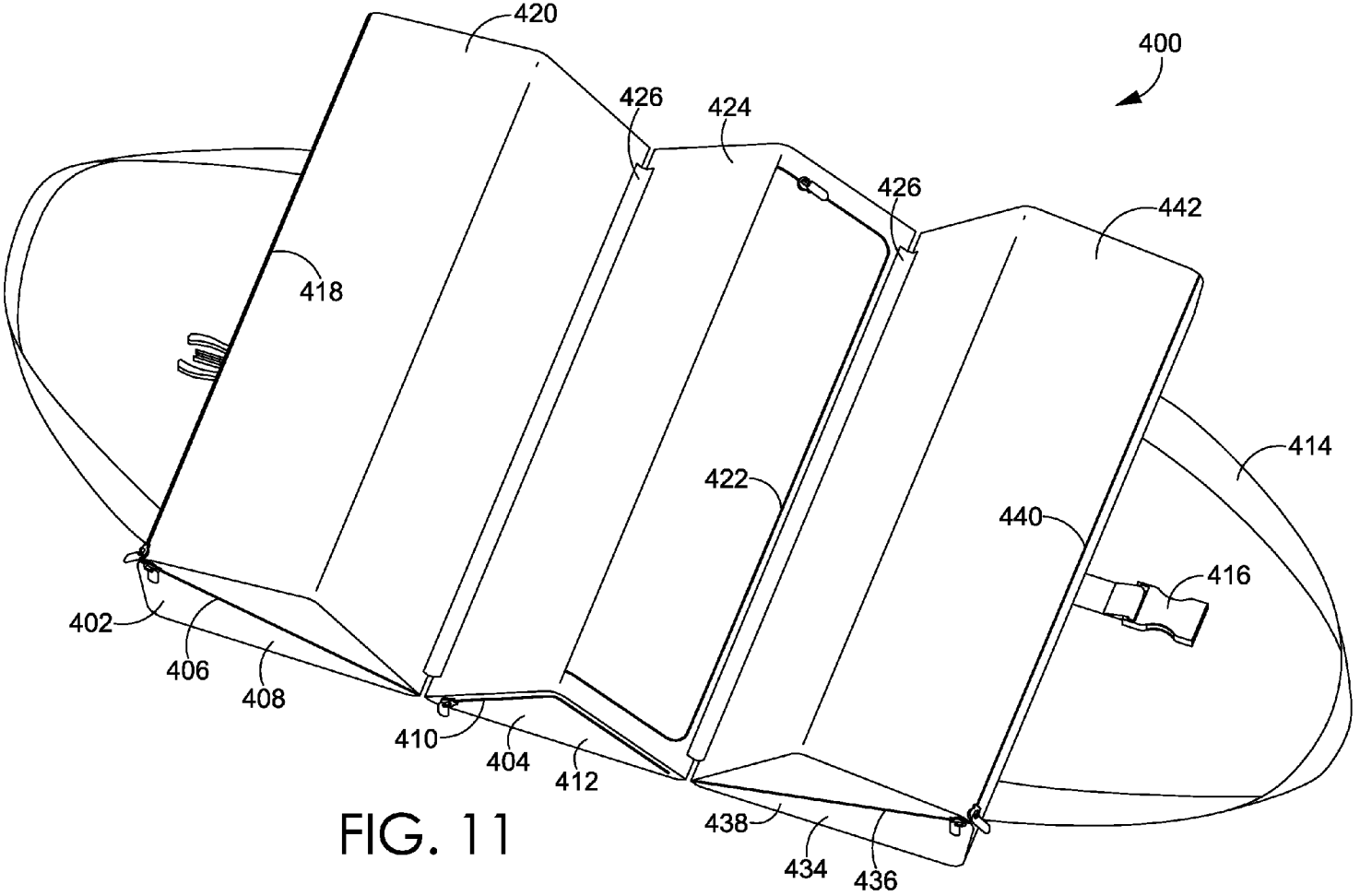
FIG. 11 depicts the bag of FIG. 10 in an unfolded configuration in accordance with an exemplary aspect hereof.
Figure 12:
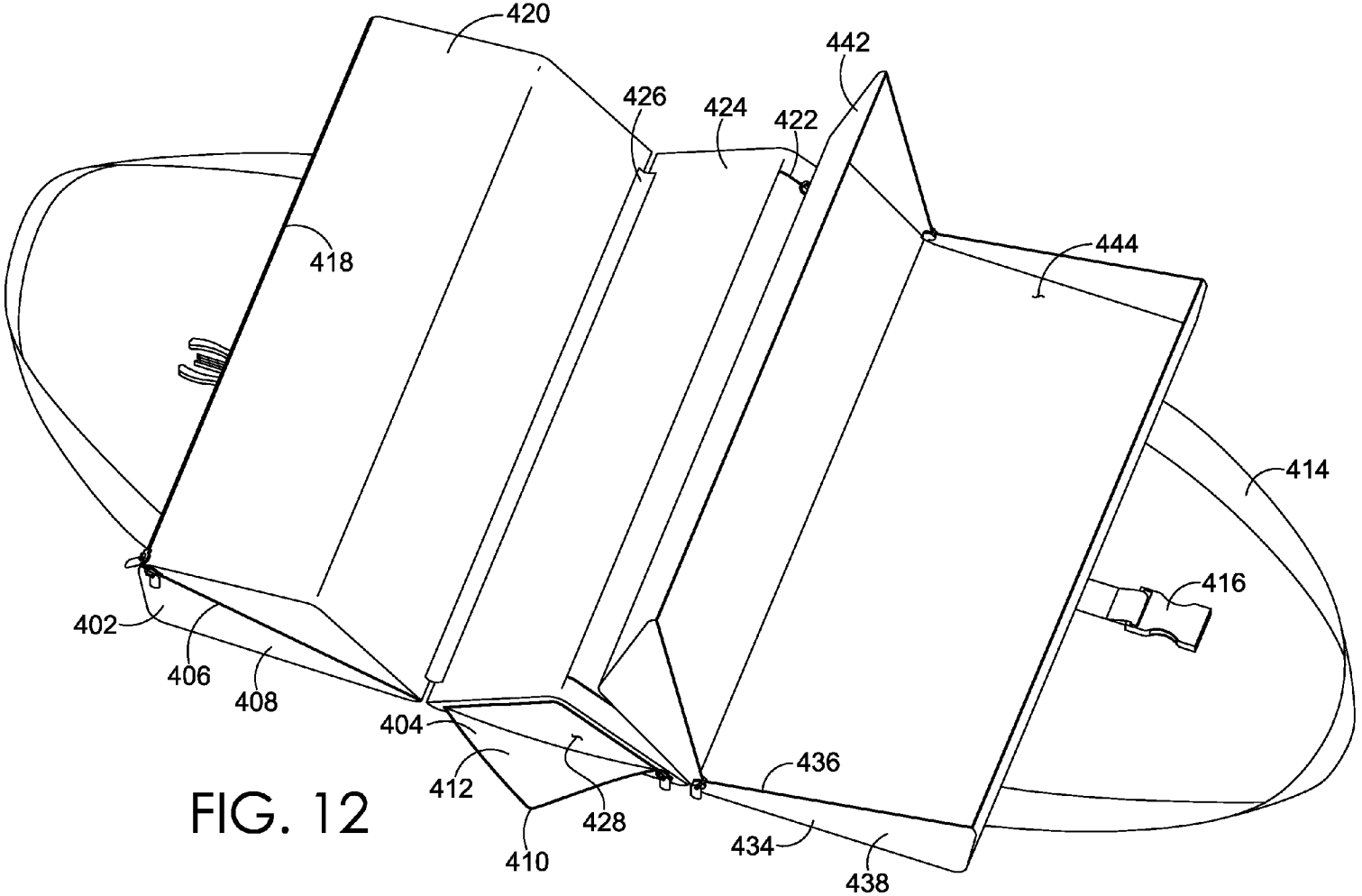
FIG. 12 depicts the bag of FIGS. 10 and 11 in an unfolded configuration with some access points open in accordance with an exemplary aspect hereof.

Referring now to FIGS. 10-12, another exemplary trifold-style bag 400 is depicted in different configurations. For instance, FIG. 10 depicts the bag 400 in a folded configuration, whereas FIGS. 11 and 12 illustrate the bag 400 in an unfolded, or lay-flat, configuration. In addition, FIG. 12 depicts an opening, which is useable to manage access to a storage compartment. Although reference might be made to a particular figure when describing this exemplary trifold-style bag, the other figures might also depict that aspect of the bag 400 and might be useful to help illustrate the various features.

FIG. 10 depicts an exemplary bag 400, which may be converted between the folded and unfolded configuration such that the second, fourth, and sixth openings 418, 422, 440 provide access to the interior of the first, second, and third compartments 402, 404, 434 for storing contents in the unfolded configuration in addition to access to the first, third, and fifth openings 406, 410, 436.

As shown in FIG. 12, the interior 444 of the third compartment 434 is accessible by manipulating the sixth opening 440 of the sixth wall 442 of the third compartment 434 to an open position. In the folded configuration, the first, third, and fifth openings 406, 410, 436, as well as additional openings 430 and 432 (see, e.g., FIG. 10), provide access to each of the interiors of the first, second, and third compartments 402, 404, 434, and/or an additional outer pouch or pocket, in various aspects.

In further aspects, a zipper or other selectively closeable or resealable fastener runs along one or more sides or walls of a compartment (e.g., third compartment 434). As such, the zipper may be partially opened along one wall (e.g., fifth wall 438) so as to correspond to an opening or access point (e.g., fifth opening 436) placed therein. Additionally, the zipper may enable access to a compartment's interior from both bag configurations when opened along a particular wall (e.g., fifth wall 438). In yet further aspects, a zipper may be partially opened along a different wall (e.g., sixth wall 442) so as to correspond to another opening or access point (e.g., sixth opening 440) placed therein. Additionally, the same zipper may not enable access to the compartment's interior from a folded configuration when opened along a particular wall (e.g., sixth wall 442).

Additional aspects of a bag will now be described, the bag having multiple compartments that each includes multiple access points and that are configurable between a lay-flat configuration and a folded configuration. When describing the bag, reference might be made to some of the drawings described in other parts of this description for illustrative purposes, but reference to these drawings (or elements of the drawings) is for descriptive purposes only to aid the reader and should not be read as a limitation into the described aspect. In an exemplary aspect, the bag (e.g., 100) includes a first compartment (e.g., 104) that includes a first set of walls (e.g., 112, 124, etc.) enclosing a first storage space (e.g., 128) and that includes a first opening (e.g., 122), which is selectively closeable to manage access to the first storage space (e.g., 128). In a further aspect, the first set of walls includes a first wall (e.g., 124) having a first-wall interior surface (e.g., 125) facing towards the first storage space and a first-wall exterior surface (e.g., 127) facing away from the first storage space, and the first compartment includes a second opening (e.g., 110) that is selectively closeable to manage access to the first storage space (e.g., 128). The bag (e.g., 100) also includes a second compartment (e.g., 102) that includes a second set of walls (e.g., 108, 120, etc.) enclosing a second storage space and that includes at least one opening (e.g., 108 or 118), which is selectively closeable to manage access to the second storage space. The second set of walls includes a second wall (e.g., 120) having a second-wall interior surface facing towards the second storage space and a second-wall exterior surface (e.g., 121) facing away from the second storage space. The bag (e.g., 100) also includes a compartment joining member (e.g., 126) that hingedly connects the first compartment (e.g., 104) and the second compartment (e.g., 102) in a bifold-style construction, such that the first compartment and the second compartment are convertible between the lay-flat configuration (e.g., FIGS. 2 and 3) and the folded configuration (e.g., FIG. 1) by hinging on the compartment joining member. In the lay-flat configuration, the first-wall exterior surface (e.g., 127) and the second-wall exterior surface (e.g., 121) are folded away from one another, such that the first wall (e.g., 124) and the second wall (e.g., 120) are alignable to be substantially coplanar. In the folded configuration, the first-wall exterior surface (e.g., 127) and the second-wall exterior surface (e.g., 121) are folded towards, and face, one another to form inward-facing surfaces of the bag (e.g., hidden from view in FIG. 1), and the second opening (e.g., 110) is positioned in an outward-facing surface (e.g., 113) of the bag.

In a further aspect, the first compartment and the second compartment are of a similar size and shape such that the bag includes a cylindrical shape when the first compartment and the second compartment are converted to the folded configuration. In such an aspect, the outward-facing surface, having the second opening positioned thereon, of the bag may extend perpendicular or substantially perpendicular to an axis of the cylindrical shape.

In yet further aspects, the first compartment and the second compartment form a body of the bag, wherein the body is substantially a geometric prism when converted to the folded configuration. Such a geometric prism might include a first n-sided (e.g., n represents any number) polygonal base and a second n-sided polygonal base that extend substantially parallel to one another. Further still, a geometric prism might include n sides that join corresponding sides of the first and second n-sided polygonal bases. An interface between the first-wall exterior surface and the second-wall exterior surface might substantially bisect both the first n-sided polygonal base and the second n-sided polygonal base, in some aspects. Additionally, the outward-facing surface of the bag, in which the second opening is positioned, may form a part, at least, of the first n-sided polygonal base, in aspects. In further aspects, the outward-facing surface of the bag, in which the second opening is positioned, might form one of the n sides of the geometric prism. For example, wherein n equals four, the first and second n-sided bases may be trapezoid shaped. In such an example, the bag (e.g., 200) may include a trapezoidal prism when the first compartment and the second compartment are converted to the folded configuration. Further still, such a trapezoidal-prism bag might include an interface between the first-wall exterior surface and the second-wall exterior surface. Such an interface might substantially bisect the trapezoid-shaped bases, in one example.

In another further aspect, the first compartment and the second compartment form a body of the bag that is substantially a three-dimensional polyhedron when converted to the folded configuration. Such a three-dimensional polyhedron might include a base that includes at least part of the first compartment and at least part of the second compartment. Further, the base may support the bag in an upright position when in the folded configuration, in aspects. The three-dimensional polyhedron may include a first end face and a second end face that generally oppose one another and that include, at least, a part of the first compartment and a part of the second compartment. In some aspects having a three-dimensional polyhedron bag, the first end face and the second end face may be substantially parallel such that the three-dimensional polyhedron substantially includes a geometric prism. For example, the three-dimensional polyhedron might include a cylindrical shaped body. Generally, the first end face and second end face include at least part of the first, second, and third compartments. The first end face and the second end face might be substantially bisected by an interface between the first-wall exterior surface and the third-wall exterior surface, in some aspects. A three-dimensional polyhedron bag might include, at least, one side face that joins the first end face to the second end face and that forms part of the first compartment, in aspects including a three-dimensional polyhedron bag. And, in such aspects, the three-dimensional polyhedron includes at least one side face that joins the first end face to the second end face and that forms part of the second compartment. The outward-facing surface of a three-dimensional polyhedron bag, having the second opening positioned thereon, might form a part of the first end face. Additionally or alternatively, the outward-facing surface of a bag might form a part of the side face that forms a part of the first compartment.

Continuing, in another exemplary aspect, a bag (e.g., 300) includes a first compartment (e.g., 302), a second compartment (e.g., 304), and a third compartment (e.g., 334). The first compartment (e.g., 302) includes a first set of walls (e.g., 308, 320) enclosing a first storage space and that includes a first opening (e.g., 306), which is selectively closeable to manage access to the first storage space. In a further aspect, the first set of walls includes a first wall having a first-wall interior surface facing towards the first storage space and a first-wall exterior surface facing away from the first storage space, and the first compartment (e.g., 302) includes a second opening (e.g., 318) that is selectively closeable to manage access to the first storage space. The bag (e.g., 300) also includes a second compartment (e.g., 304) that includes a second set of walls (e.g., 312, 324, etc.) enclosing a second storage space (e.g., 328) and that includes at least one opening (e.g., 310, 322), which is selectively closeable to manage access to the second storage space. The second set of walls includes a second wall having a second-wall interior surface facing towards the second storage space and a second-wall exterior surface facing away from the second storage space. The bag (e.g., 300) also includes a third compartment (e.g., 334) that includes a third set of walls (e.g., 338, 342, etc.) enclosing a third storage space (e.g., 344) and that includes at least one opening (e.g., 336, 340), which is selectively closeable to manage access to the third storage space. The third set of walls includes a third wall having a third-wall interior surface facing towards the third storage space and a third-wall exterior surface facing away from the third storage space. The bag may also include one or more compartment joining members (e.g., 326) that hingedly connect the first compartment (e.g., 302), the second compartment (e.g., 304), and the third compartment (e.g., 334) to one another, such that the first compartment, the second compartment and the third compartment are convertible between the lay-flat configuration (e.g., FIGS. 8 and 9) and the folded configuration (e.g., FIG. 7) by hinging on the one or more compartment joining members. In the lay-flat configuration, the first-wall exterior surface, the second-wall exterior surface and the third-wall exterior surface (e.g., shown as the second wall 320, fourth wall 324, and sixth wall 342 in FIG. 8) are folded away from one another, such that the first wall, the second wall, and the third wall are alignable to be substantially coplanar. In the folded configuration, the first-wall exterior surface, the second-wall exterior surface, and the third-wall exterior surface (e.g., second wall 320, fourth wall 324, and sixth wall 342 in FIG. 8) are folded towards, and face, one another to form inward-facing surfaces of the bag (e.g., hidden from view in FIG. 7), and the second opening (e.g., third opening 310) is positioned in an outward-facing surface of the bag. Again, references made to some of the drawings described in other parts of this description are for illustrative purposes only and should not be read as a limitation into the described aspect.

Continuing, when the bag is converted to the folded configuration, the first, second, and third compartments may form a body that is substantially a three-dimensional polyhedron, in another aspect. Generally, an exemplary three-dimensional polyhedron includes a base that supports the bag in an upright position when in the folded configuration. Further, in aspects, the three-dimensional polyhedron includes a first end face and a second end face that generally oppose one another. In further aspects, the first end face and the second end face may be substantially parallel such that the three-dimensional polyhedron substantially includes a geometric prism. For example, the three-dimensional polyhedron might include a cylindrical shaped body. Generally, the first end face and second end face include at least part of the first, second, and third compartments. The first end face and the second end face might be substantially trisected by an interface between the first, second, and third compartments, as well. In further aspects, the three-dimensional polyhedron includes a first side face and a second side face that joins the first end face to the second end face. At least part of the first side face may be formed by the outward-facing surface of the bag in which the second opening is positioned, in aspects where the first compartment is joined to only one of the second compartment and the third compartment by way of the one or more compartment joining members. Alternatively, the first compartment might be joined to both the second compartment and the third compartment by way of the one or more compartment joining members such that the outward-facing surface of the bag, in which the second opening is positioned, forms at least part of the first end face.

In yet another aspect, a bag with multiple compartments that each includes multiple access points and that are configurable between a lay-flat configuration and a folded configuration is provided. The bag includes a first side compartment having a first access point placed in a first wall and a second access point placed in a second wall and a second side compartment having a third access point placed in a third wall and a fourth access point placed in a fourth wall. Additionally, the bag includes a middle compartment positioned between the first side compartment and the second side compartment. The middle compartment includes a fifth access point placed in a fifth wall and a sixth access point placed in a sixth wall. One or more compartment joining members hingedly connect the first side compartment to the second side compartment and the second side compartment to the middle compartment, such that the first side compartment, the second side compartment, and the middle compartment are convertible between the lay-flat configuration and the folded configuration by hinging on the one or more compartment joining members. When the bag is in the lay-flat configuration, the one or more compartment joining members are hinged open such that the first side compartment, the second side compartment, and the middle compartment are consecutively placed and separated so that all of the first, second, third, fourth, fifth, and sixth access points are accessible as placed on the first, second, third, fourth, fifth and sixth walls, respectively. When the bag is in the folded configuration, the one or more compartment joining members are closed. When the one or more compartment joining members are closed, the first side compartment, the middle compartment, and the second side compartment fit together to form a bag body having a support base, end-wall portions, and side-wall portions connecting the end-wall portions to one another. Further, the fifth wall forms at least part of one of the end-wall portions and the first access point, third access point, and fifth access point are accessible in the folded configuration. Further still, the second wall, the fourth wall, and the sixth wall face at least one wall of an adjacent compartment and are positioned interiorly within the bag body.

In one aspect, certain features of a bag facilitate efficient and easy organization of stored items. For instance, each of the multiple compartments logically allows for sorting personal belongings into categories, such as general types of items (e.g., toiletries, equipment, snacks, or shoes), activity-specific items (e.g., running or ballet), and/or timing-sensitive items (e.g., pre-activity, during activity, and post-activity or recovery). In addition, the distinct compartments may store belongings corresponding to a user's preferences (e.g., organized according to an athlete's particular personal routine). For example, a marathon runner may store his or her pre-race needs (e.g., carbohydrate heavy snacks, athletic tape, anti-chafing cream) in a first compartment and his or her preferred post-race needs (e.g., electrolytic rehydration drinks, ibuprofen, blister relief, topical heat rub, dry socks) in a second compartment of an exemplary bag. The organization provided by the compartments enables the marathon runner to quickly and easily prepare, mentally and practically, for a race or qualifier. Exemplary bags may include additional aspects and/or features that promote further organization of stowed belongings such as internal compartment dividers, pockets, sleeves, and/or semi-transparent or transparent materials.

The at least two configurations of the bag facilitate quick and easy organization when packing or stowing personal belongings as well. The configurations include, at least, a lay-flat (e.g., unfolded) configuration and a folded configuration. In a lay-flat configuration, each of the multiple compartments may be spread, splayed, or otherwise laid out such that the bag is made to lay flat or substantially flat. As such, the compartments are separate from one another but each is attached to a compartment joining member. The separated compartments enable a user to personally organize belongings when packing the bag. Each of the multiple compartments may be opened to pack belongings and closed to secure the belongings therein. Each compartment includes more than one opening or access point.

Each opening or access point generally includes a fastener that can be manipulated to open and close the opening or access point of a corresponding compartment such that the opening or access point is resealable. Exemplary fasteners may include a zipper, a snap fastener, a magnetic button, a hook-and-loop fastener, or a cord and cord-lock, for example. Generally, manipulating an opening into an open position (e.g., an unzipped zipper) provides access to the interior of the compartment so that belongings may be stored. Additionally, manipulating an opening into a closed position (e.g., a zipped zipper) retains belongings stored therein by preventing movement of the belongings out of the corresponding compartment.

After packing the compartments of the bag in the lay-flat configuration and closing the openings of the compartments to secure belongings stored therein, the bag may be manipulated into a folded configuration for comfortable and easy transport by the user, for example. The folded configuration is generally a more compact configuration than the lay-flat configuration. In the folded configuration, the user may wear or carry the bag. Each compartment includes more than one opening that provides access to the compartment's interior whether the bag is in the lay-flat or the folded configuration, in aspects. Additionally, in the folded configuration, the user may use openings for each compartment to access the compartment's interiors and any contents or belongings stored therein. As such, the user need not change the configuration of the bag from folded to lay-flat in order to quickly and easily access stowed belongings. This avoids the inconvenience of unfolding the bag and/or disturbing the arrangement of packed personal belongings in the other compartments.

While the examples of bags might be presented in a simplified fashion for exemplary purposes herein, in practice, a bag may include any number of compartments and may be formed from different types of materials. Exemplary bags may include additional aspects and/or features, including comfort components (e.g., cushioning or padding on shoulders straps, a lumbar pillow); functional components that reduce the shifting of stored belongings and weight imbalance of the load during wear; elements that protect the bag, stored personal belongings, or a user of the bag (e.g., water resistant coating, stain resistant treatments, reflective or improved visibility features); and/or the like. Although these and other aspects of the bag are not specifically described in examples herein, such aspects may be present in the bag in accordance with aspects hereof.

From the foregoing, it will be seen that this disclosure is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

The invention claimed is:

1. A bag with multiple compartments that each includes multiple access points and that are configurable between a lay-flat configuration and a folded configuration, the bag comprising:

a first compartment that includes a first set of walls enclosing a first storage space and that includes a first opening, which is selectively closeable to manage access to the first storage space, wherein the first set of walls includes a first wall having a first-wall interior surface facing towards the first storage space and a first-wall exterior surface facing away from the first storage space, and wherein the first compartment includes a second opening that is selectively closeable to manage access to the first storage space;

a second compartment that includes a second set of walls enclosing a second storage space and that includes at least one opening, which is selectively closeable to manage access to the second storage space, wherein the second set of walls includes a second wall having a second-wall interior surface facing towards the second storage space and a second-wall exterior surface facing away from the second storage space, and a compartment joining member that hingedly connects the first compartment and the second compartment in a bifold-style construction, such that the first compartment and the second compartment are convertible between the lay-flat configuration and the folded configuration by hinging on the compartment joining member, wherein in the lay-flat configuration the first-wall exterior surface and the second-wall exterior surface are folded away from one another, such that the first wall and the second wall are alignable to be substantially coplanar;

wherein in the folded configuration the first-wall exterior surface and the second-wall exterior surface are folded towards, and face, one another to form inward-facing surfaces of the bag; and wherein in the folded configuration, the second opening is positioned in an outward-facing surface of the bag.

2. The bag of claim 1, wherein the first compartment and the second compartment form a body that is substantially a geometric prism when converted to the folded configuration, wherein the geometric prism includes a first n-sided polygonal base and a second n-sided polygonal base that extend substantially parallel to one another, and wherein the geometric prism includes n sides that join corresponding sides of the first and second n-sided polygonal bases.

3. The bag of claim 2, wherein an interface between the first-wall exterior surface and the second-wall exterior surface substantially bisects both the first n-sided polygonal base and the second n-sided polygonal base.

4. The bag of claim 3, wherein the outward-facing surface of the bag, in which the second opening is positioned, forms at least part of the first n-sided polygonal base.

5. The bag of claim 3, wherein the outward-facing surface of the bag, in which the second opening is positioned, forms at least one of the n sides of the geometric prism.

6. The bag of claim 2, wherein n equals four, such that the bag includes a trapezoidal prism when the first compartment and the second compartment are converted to the folded configuration, such that the first and second n-sided bases are trapezoid shaped.

7. The bag of claim 6, wherein an interface between the first-wall exterior surface and the second-wall exterior surface substantially bisects the trapezoid-shaped bases.

8. The bag of claim 1, wherein the first compartment and the second compartment are of a similar size and shape, and wherein the bag includes a cylindrical shape when the first compartment and the second compartment are converted to the folded configuration.

9. The bag of claim 8, wherein the outward-facing surface of the bag, in which the second opening is positioned, extends substantially perpendicular to an axis of the cylindrical shape.

10. The bag of claim 8, wherein the outward-facing surface of the bag, in which the second opening is positioned, extends substantially parallel with an axis of the cylindrical shape.

11. The bag of claim 1, wherein the first compartment and the second compartment form a body that is substantially a three-dimensional polyhedron when converted to the folded configuration, wherein the three-dimensional polyhedron includes a base that is comprised of at least part of the first compartment and at least part of the second compartment and that supports the bag in an upright position when in the folded configuration, wherein the three-dimensional polyhedron includes a first end face and a second end face that generally oppose one another, that are comprised of at least part of the first compartment and at least part of the second compartment, and that are substantially bisected by an interface between the first-wall exterior surface and a third-wall exterior surface, wherein the three-dimensional polyhedron includes at least one side face that joins the first end face to the second end face and that forms part of the first compartment, and wherein the three-dimensional polyhedron includes at least one side face that joins the first end face to the second end face and that forms part of the second compartment.

12. The bag of claim 11, wherein the outward-facing surface of the bag, in which the second opening is positioned, forms at least part of the first end face.

13. The bag of claim 11, wherein the outward-facing surface of the bag, in which the second opening is positioned, forms at least part of the at least one side face that forms part of the first compartment.

14. A bag with multiple compartments that each includes multiple access points and that are configurable between a lay-flat configuration and a folded configuration, the bag comprising:

a first compartment including a first set of walls that encloses a first storage space and that includes a first opening, which is selectively closeable to manage access to the first storage space, wherein the first set of walls includes a first wall having a first-wall interior surface facing towards the first storage space and a first-wall exterior surface facing away from the first storage space, and wherein the first set of walls includes a second opening that is selectively closeable to manage access to the first storage space;

a second compartment including a second set of walls that encloses a second storage space and that includes a third opening, which is selectively closeable to manage access to the second storage space, wherein the second set of walls includes a second wall having a second-wall interior surface facing towards the second storage space and a second-wall exterior surface facing away from the second storage space, wherein the second set of walls includes a fourth opening that is selectively closeable to manage access to the second storage space;

a third compartment including a third set of walls that encloses a third storage space and that includes at least one third-compartment opening, which is selectively closeable to manage access to the third storage space, wherein the third set of walls includes a third wall having a third-wall interior surface facing towards the third storage space and a third-wall exterior surface facing away from the third storage space; and one or more compartment joining members that hingedly connect the first, second, and third compartments to one another, such that the first, second, and third compartments are convertible between the lay-flat configuration and the folded configuration by hinging on the one or more compartment joining members, wherein in the folded configuration the first-wall exterior surface and the second-wall exterior surface are folded towards, and face, one another to form inward-facing surfaces of the bag; and wherein in the folded configuration, the second opening and the fourth opening are positioned in an outward-facing surface of the bag.

15. The bag of claim 14, wherein the first, second, and third compartments form a body that is substantially a three-dimensional polyhedron when converted to the folded configuration, wherein the three-dimensional polyhedron includes a base that supports the bag in an upright position when in the folded configuration, wherein the three-dimensional polyhedron includes a first end face and a second end face that generally oppose one another, that are comprised of at least part of the first, second, and third compartments, and that are substantially trisected by an interface between the first, second, and third compartments, and wherein the three-dimensional polyhedron includes at least a first side face and a second side face that join the first end face to the second end face.

16. The bag of claim 15, wherein the first compartment is joined to only one of the second compartment and the third compartment by way of the one or more compartment joining members, and wherein the outward-facing surface of the bag, in which the second opening is positioned, forms at least part of the first side face.

17. The bag of claim 15, wherein the first compartment is joined to both the second compartment and the third compartment by way of the one or more compartment joining members, and wherein the outward-facing surface of the bag, in which the second opening is positioned, forms at least part of the first end face.

18. The bag of claim 15, wherein the first end face and the second end face are substantially parallel, such that the three-dimensional polyhedron substantially includes a geometric prism.

19. The bag of claim 15, wherein the three-dimensional polyhedron includes a cylindrical shaped body.

20. A bag with multiple compartments that each includes multiple access points and that are configurable between a lay-flat configuration and a folded configuration, the bag comprising:

a first side compartment having a first access point placed in a first wall and a second access point placed in a second wall;

a second side compartment having a third access point placed in a third wall and a fourth access point placed in a fourth wall;

a middle compartment positioned between the first side compartment and the second side compartment and having a fifth access point placed in a fifth wall and a sixth access point placed in a sixth wall; and one or more compartment joining members that hingedly connect the first side compartment to the middle compartment and the middle compartment to the second side compartment, such that the first side compartment, the middle compartment, and the second side compartment are convertible between the lay-flat configuration and the folded configuration by hinging on the one or more compartment joining members, wherein in the lay-flat configuration, the one or more compartment joining members are hinged open, such that the first side compartment, the middle compartment, and the second side compartment are consecutively placed and separated so that all of the first, second, third, fourth, fifth, and sixth access point are accessible as placed on the first, second, third, fourth, fifth, and sixth walls, respectively, wherein in the folded configuration, the one or more compartment joining members are hinged closed, such that first side compartment, the middle compartment, and the second side compartment fit together to form a bag body having a support base, end-wall portions, and side-wall portions connecting the end-wall portions to one another, wherein the fifth wall forms at least part of one of the end-wall portions and the first access point, third access point, and fifth access point are accessible in the folded configuration, and wherein in the folded configuration the second wall, the fourth wall, and the sixth wall face at least one wall of an adjacent compartment and are positioned interiorly within the bag body.

* * * * *